US006663675B2

(12) United States Patent
Blake et al.

(10) Patent No.: US 6,663,675 B2
(45) Date of Patent: Dec. 16, 2003

(54) PIVOTING COIN INPUT TRAY FOR A COIN PROCESSING DEVICE

(75) Inventors: John R. Blake, St. Charles, IL (US); John H. Kutsch, Harvard, IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 0 days.

(21) Appl. No.: 10/116,191

(22) Filed: Apr. 4, 2002

(65) Prior Publication Data

US 2003/0190882 A1 Oct. 9, 2003

(51) Int. Cl.[7] ..... G07D 9/06; G07D 1/00; G07F 1/07

(52) U.S. Cl. ..... 753/63; 194/347; 193/DIG. 1; 232/65

(58) Field of Search ..... 453/63, 18; 209/38; 193/DIG. 1; 194/344, 347, 348, 351, 353; 414/287, 639, 340; 232/1 D, 44, 55, 57, 58, 63, 64, 65

(56) References Cited

U.S. PATENT DOCUMENTS

| | | | | |
|---|---|---|---|---|
| 3,667,484 A | | 6/1972 | Reis | 133/8 |
| 3,965,912 A | | 6/1976 | Gross | 133/1 |
| 4,493,454 A | | 1/1985 | Giebelhausen et al. | 232/15 |
| 4,629,051 A | | 12/1986 | Abe | 194/261 |
| 4,964,495 A | * | 10/1990 | Rasmussen | 194/344 |
| 5,027,936 A | | 7/1991 | Boyett | 194/325 |

(List continued on next page.)

FOREIGN PATENT DOCUMENTS

| | | | | |
|---|---|---|---|---|
| EP | 0 391 234 B1 | | 5/1995 | G07D/9/00 |
| EP | 0 622 763 B2 | | 8/2000 | G07D/3/12 |
| JP | 2-12589 A | * | 1/1990 | G07D/9/00 |
| JP | 5-12539 A | * | 1/1993 | G07D/9/00 |

OTHER PUBLICATIONS

Model 958 Brandt Coin Sorter/Counter Product Brochure (5 pages) © 1982 Brandt, Inc.

De La Rue Systems Mach 3 Operations Manual (19 pages; some double–sided) © 1997.

JetSort® High Speed Coin Sorter/Counter 2000 Series Product Brochure (2 pages) (undated).

Complaint, Cummins–Allison Corp. v. Glory Ltd., Glory Shoji Co. Ltd., and Glory(U.S.A.) Inc., Civil Action No. 02C–7008, United States District Court, Northern District of Illinois, Eastern Division.

Billcon Corporation, Brochure for CCS–60/CCS–80 Series Coin Counter–Sorter, 2 pages (Oct. 1999).

Billcon Corporation, Photos for CCS–60/80, 1 page (Japanese language) (Oct. 12, 2000).

De La Rue Cash Systems, Inc., Brochure for ACD Automatic Coin Dispenser, 2 pages (no date).

De La Rue Cash Systems, Brochure for MACH 12 Coin Sorter/Counter, 2 pages (1999).

De La Rue Cash Systems, Brochure for MACH 12HD Coin Sorter/Counter, 2 pages (no date).

Glory, Brochure for GSA–500 Sortmaster, 2 pages (no date).

Magner, Brochure for COINSTREAM™ CPS 502 Self–Serivce Coin Processing System, 2 pages (no date).

Magner, Brochure for MAG II 100 Series Coin Sorters, 2 pages (no date).

(List continued on next page.)

*Primary Examiner*—Donald P. Walsh
*Assistant Examiner*—Mark Beauchaine
(74) *Attorney, Agent, or Firm*—Jenkens & Gilchrist

(57) ABSTRACT

A coin input apparatus for a coin processing device comprises a coin tray pivotally coupled to the device for feeding coins into the device and a coin chute for guiding coins from the coin tray into the device. The coin tray has a corrugated surface. The coin chute has a corrugated surface for mating with the corrugated surface of the coin tray for minimizing a gap between the coin tray and the coin chute.

42 Claims, 7 Drawing Sheets

U.S. PATENT DOCUMENTS

| | | | | | |
|---|---|---|---|---|---|
| 5,429,551 | A | * | 7/1995 | Uecker et al. | 453/18 |
| 5,443,419 | A | | 8/1995 | Adams et al. | 453/17 |
| 5,564,546 | A | | 10/1996 | Molbak et al. | 194/216 |
| 5,620,079 | A | | 4/1997 | Molbak | 194/217 |
| 5,746,299 | A | | 5/1998 | Molbak et al. | 194/200 |
| 5,799,767 | A | | 9/1998 | Molbak | 194/217 |
| 5,830,056 | A | | 11/1998 | Adams et al. | 453/63 |
| 5,842,916 | A | | 12/1998 | Gerrity et al. | 453/57 |
| 6,004,200 | A | | 12/1999 | Ebenhoch et al. | 453/63 |
| 6,021,883 | A | | 2/2000 | Casanova et al. | 194/217 |
| 6,047,807 | A | | 4/2000 | Molbak | 194/217 |
| 6,093,094 | A | * | 7/2000 | Uecker et al. | 453/16 |
| 6,174,230 | B1 | | 1/2001 | Gerrity et al. | 453/57 |
| 6,264,545 | B1 | | 7/2001 | Magee et al. | 453/3 |
| 6,318,536 | B1 | * | 11/2001 | Korman et al. | 194/217 |
| 2003/0010599 | A1 | * | 1/2003 | Svensson | 194/347 |

OTHER PUBLICATIONS

Magner, Brochure for MAG II Model 915 Coin Counter/Packager, 2 pages (no date).

Magner, Brochure for Pelican 305 Coin Sorter, 2 pages (no date).

Magner, Brochure for 900 Series Coin Counters and Packagers, 2 pages (no date).

* cited by examiner

PIVOTING COIN INPUT TRAY FOR A COIN PROCESSING DEVICE

FIELD OF THE INVENTION

This invention relates generally to coin input devices for coin processing devices, and more particularly to a pivoting coin input tray for a coin processing device.

BACKGROUND OF THE INVENTION

Generally, coins are input to coin processing devices, such as coin sorters, in one of two ways. According to one approach, coins are deposited (i.e., dumped) directly by an operator into the coin processing device so that coins fall directly from the operator's control to inside the coin processing device. According to another approach, coins are first deposited into a pivotal coin tray and then the tray is pivoted upward to move the coins, which flow under the force of gravity, into the coin processing device.

Pivotal coin trays are constructed such that coins are inhibited from moving into the coin processing device until the coin tray is lifted. This construction allows an operator of the coin processing device to load the coin tray while a prior batch of coins is being processed by the device. One type of pivoting coin tray arrangement found in the prior art includes a pivoting coin tray disposed adjacent to a coin chute, which directs coins into the coin processing device. As the coin tray is upwardly pivoted, the coin tray funnels the coins over an upper rim of the coin chute and into the coin chute.

One drawback associated with this type of arrangement is that coins can become lodged in a gap between the coin tray and the coin chute. Further, depending how the coin tray pivots in relation to the coin chute, this gap can increase as the coin tray is lifted to move coins into the coin processing device. Coins can become lodged in this gap, which often results in damage to the coins and to the coin tray. Further, coins may fall through the gap. A related drawback is that these types of coin trays have very tight manufacturing tolerances so that the size of the described gap is reduced.

Accordingly, there exits a need for a pivoting coin tray that reduces the size of any gap between the coin tray and pivot block.

SUMMARY OF THE INVENTION

A coin input apparatus for a coin processing device comprises a coin tray pivotally coupled to the device for feeding coins into the device and a coin chute for guiding coins from the coin tray into the device. The coin tray has a corrugated surface. The coin chute has a corrugated surface for mating with the corrugated surface of the coin tray for minimizing a gap between the coin tray and the coin chute.

The above summary of the present invention is not intended to represent each embodiment, or every aspect, of the present invention. Additional features and benefits of the present invention will become apparent from the detailed description, figures, and claims set forth below.

Figure 1:
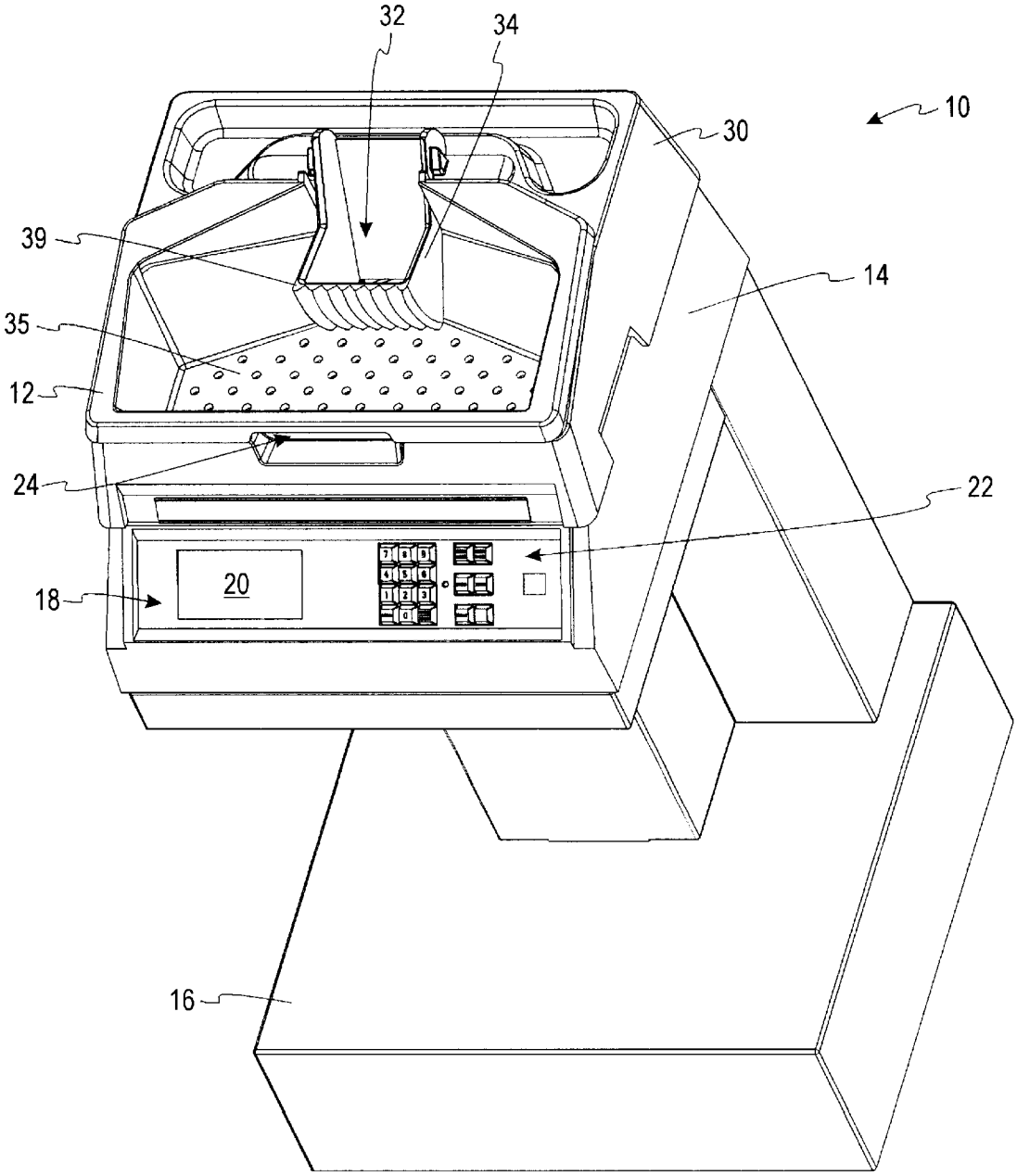
FIG. 1 is a perspective view of a coin processing system having a pivoting coin input tray according to one embodiment of the present invention.

While the invention is susceptible to various modifications and alternative forms, specific embodiments will be shown by way of example in the drawings and will be desired in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

Turning now to the drawings and referring first to FIG. 1, a coin sorter 10 having a pivoting coin input tray 12 ("coin tray") is shown. The coin tray 12 holds coins prior to inputting some or all of the coins in the coin tray 12 to the coin sorter 10. The coin tray 12 transfers the coins by pivoting upward causing coins deposited therein to move, under the force of gravity, to a sorting mechanism (not shown) disposed within a cabinet 14. The sorting mechanism discharges sorted coins to a plurality of coin bags (not shown), or other coin receptacles, that are suspended from the cabinet 14, the bottoms of the bags resting upon a platform 16. While the coin tray 12 of the present invention is shown and is discussed in connection with the coin sorter 10, the coin tray 12 can be used with coin counters, rail-type coin sorters, coin redemption machines and other types of coin processing devices according to alternative embodiments of the present invention.

An operator interface 18 interacts with a controller (not shown) of the coin sorter 10. The controller determines the coin totals during sorting, controls the termination of coin sorting (e.g., when a predetermined number of coins have been transferred to a coin bag) and calculates pertinent data regarding the sorted coins. The operator interface includes a display 20 for displaying information to an operator of the coin sorter 10 and a keypad 22 for receiving input from an operator of the coin sorter 10. Input from an operator of the coin sorter 10 can include selection of predefined modes of operation, instructions for defining modes of operation, requests for certain output to be displayed on the display 20 and/or an optional printer (now shown), identification information such as an identification code for identifying particular transactions or batches of coins, etc. According to an alternative embodiment, the operator interface 18 comprises a touch screen type display/interface.

During consecutive batch sorting operations, an operator dumps coins into the coin tray 12 and inputs an identification number along with any additional data via the interface 18. The operator then transfers the coins within the coin tray 12 to the sorting mechanism. While the coins are being sorted, the operator can dump the next batch of coins into the coin tray 12 and enter data corresponding to the next batch.

Figure 2A:
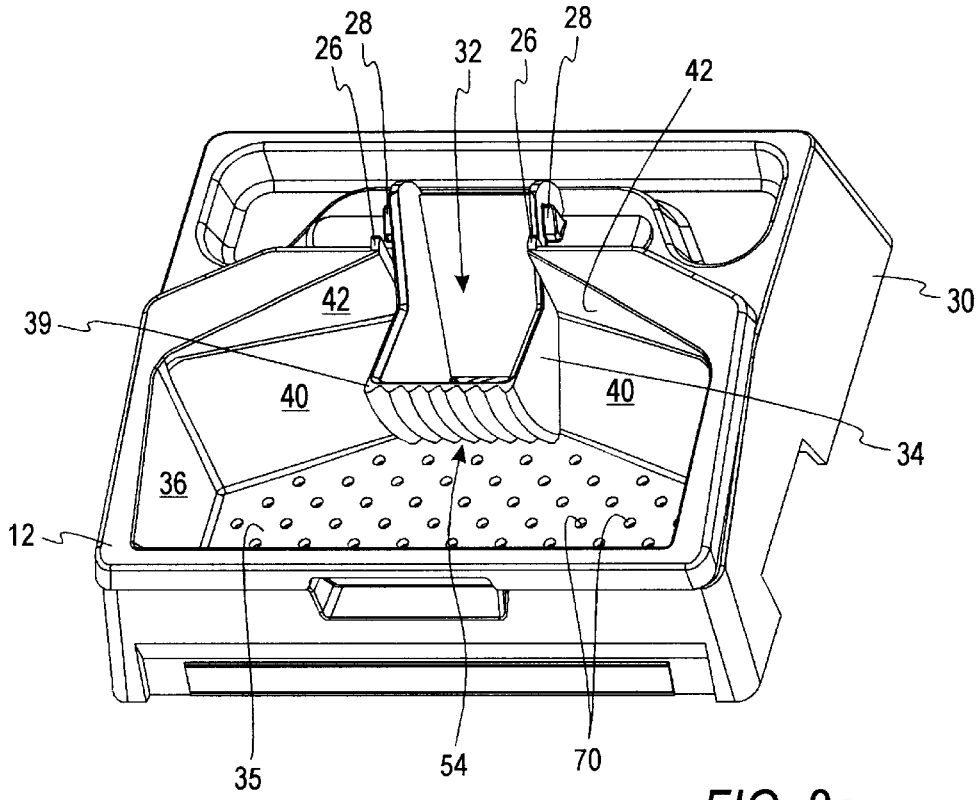
FIGS. 2*a* and 2*b* are perspective views of the coin tray of the coin processing system of FIG. 1 shown in a first coin receiving position and a second coin transferring position, respectively.
Figure 2B:
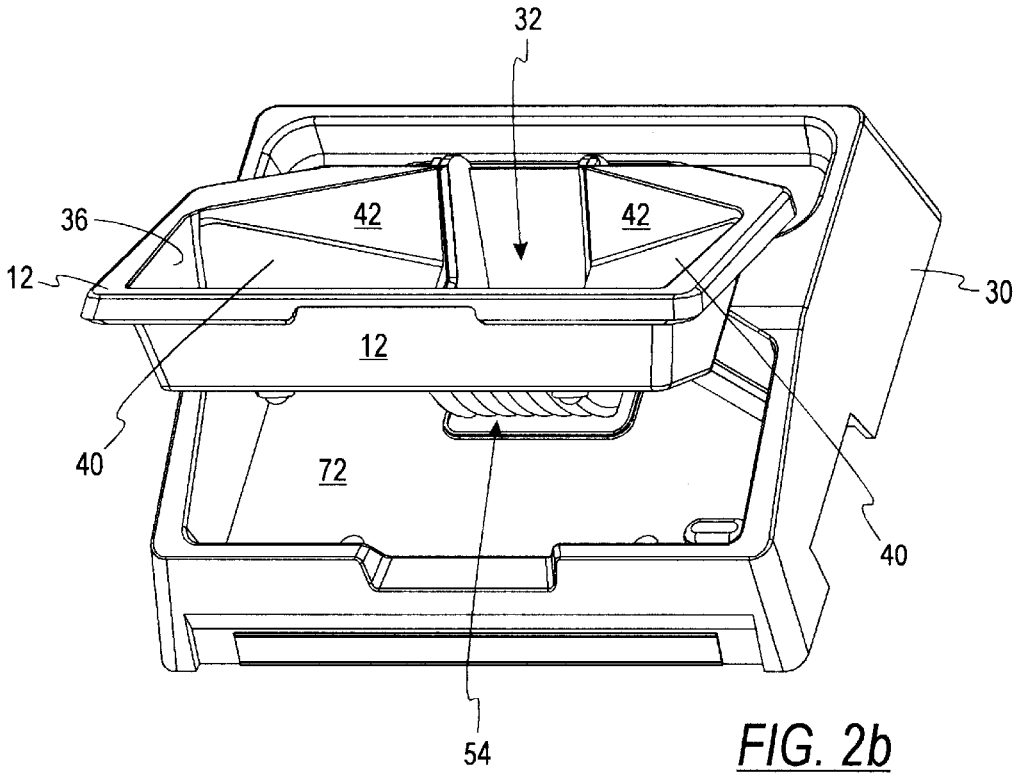
Figure 3A:
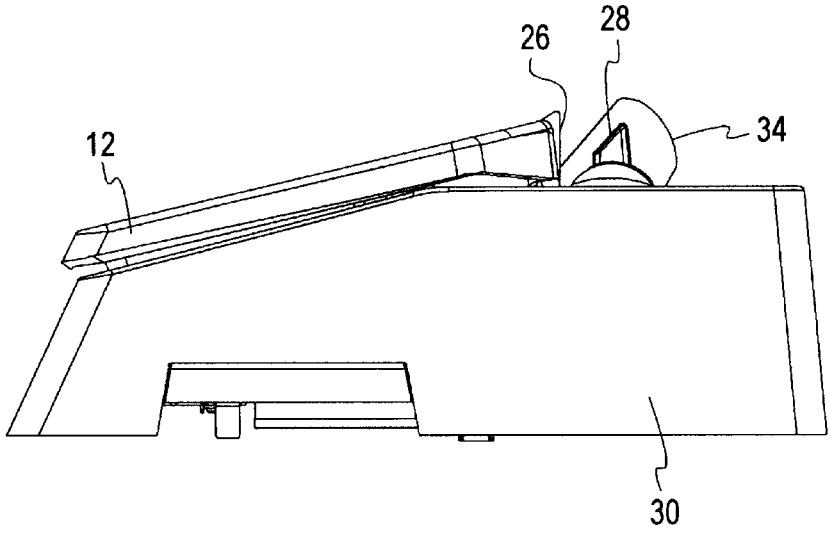
FIGS. 3*a* and 3*b* are side views of the coin tray of the coin processing system of FIG. 1 shown in a first coin receiving position and a second coin transferring position, respectively.
Figure 3B:
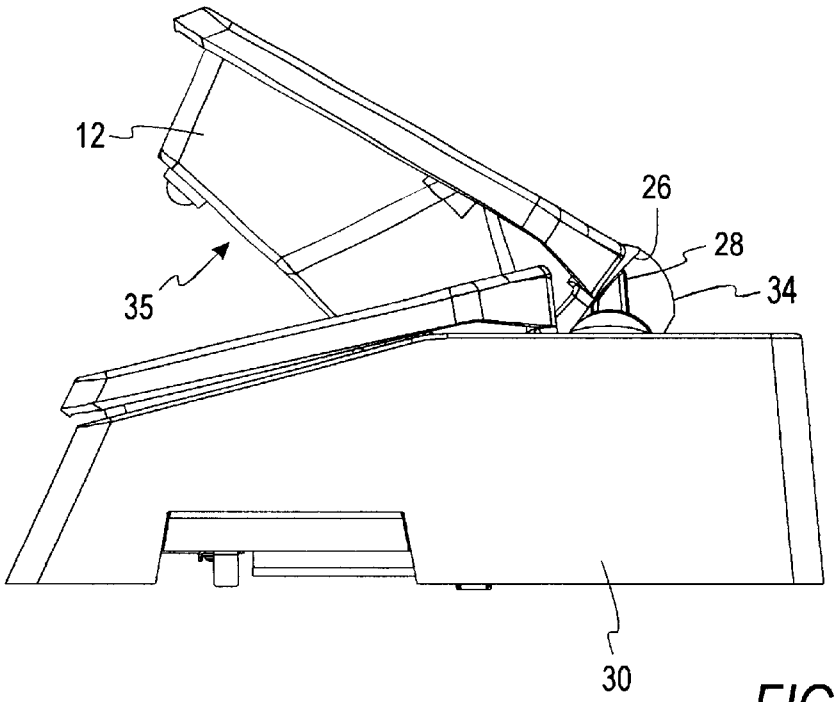
Figure 4:
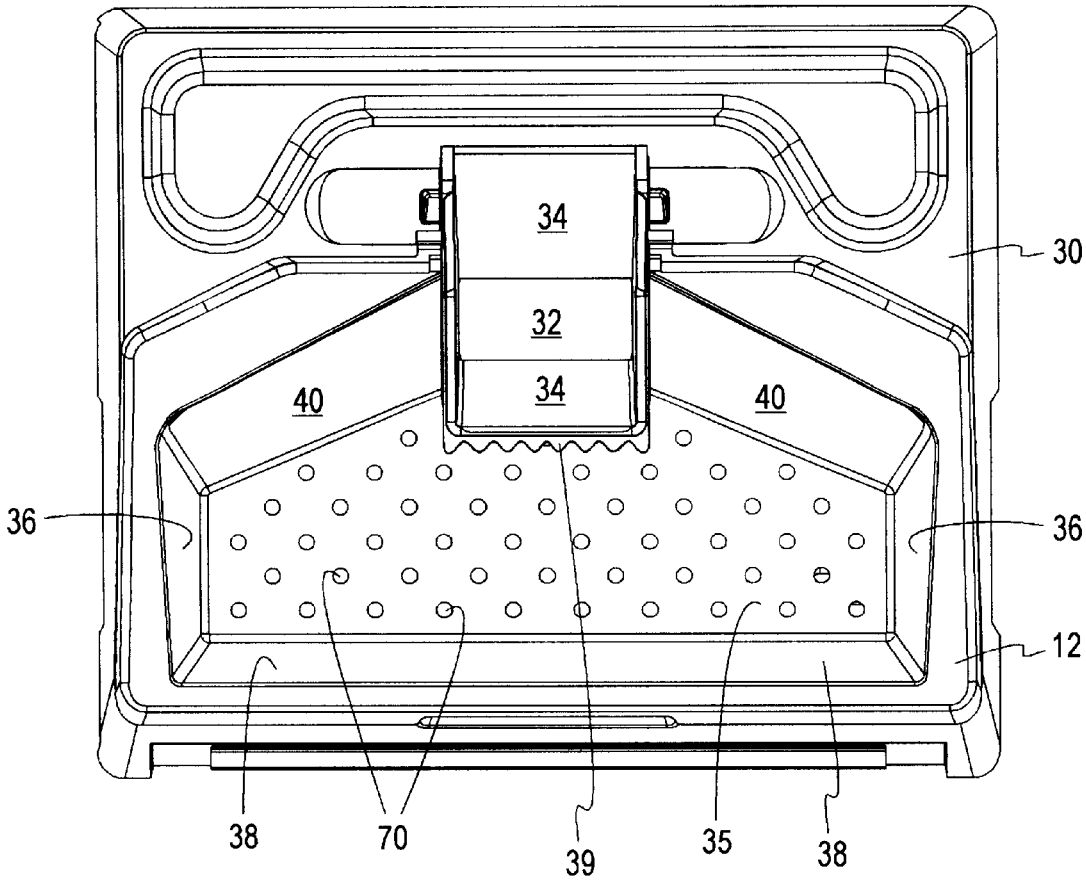
FIG. 4 is a top view of the coin tray of the coin processing system shown in FIG. 1.

Referring now to FIGS. 2*a*–4, an operator of the coin sorter 10 pivots the coin tray 12 between a first position for receiving coins (FIGS. 2*a* and 3*a*) and a second position for feeding coins into the coin sorter 10 (FIGS. 2*b* and 3*b*). When the coin tray 12 is in the second position, the coins flow from the coin tray 12 under the force of gravity out of the coin tray 12 and into the coin sorting mechanism of the coin sorter 10. The coin tray 12 is pivotally coupled to the base and includes a pair of disk-shaped protrusions 23 (FIG. 5) which are received by a corresponding pair of sockets (not shown) in the base 30, which form a hinge between the coin tray 12 and the base 30. The base 30 mounts to the top of the cabinet 14 of the coin sorter 10. The coin tray includes a handle 24 which the operator of the coin sorter 10 grasps when pivoting the coin tray 12 from first position to the second position and back to the first position. As the coin tray 12 is pivoted upward, coins are directed to an opening 32 of a coin chute 34 that directs the coins through an aperture (not shown) in the base to the sorting mechanism within the cabinet 14.

The coin tray 12 is positioned substantially parallel to the horizontal when in the first coin receiving position. When pivoting to the second position for moving coins into the coin chute 34, the coin tray 12 is pivoted so that a bottom 35 of the coin tray 12 is disposed at a maximum angle of about 50° with respect to the horizontal. To prevent further rotation of the coin tray 12, the coin tray 12 includes a pair of stops 28 which contact an opposing pair of stops 28 disposed on the funnel. In other embodiments, the opposing pair of stops are disposed on the base 30. As the coin tray 12 is pivoted, the stops 26 on the coin tray 12 contact the stops 28 of the coin chute 34, which prohibit any further pivoting of the coin tray 12.

The coin tray 12 includes a plurality of side walls including two side walls 36, a front wall 38 and back walls having lower portions 40 and upper portions 42, which extend upwardly from a bottom plate 35. The two side walls 36 and a front wall 38 that are acutely angled with respect to the vertical. The two side walls 36 the front wall 38 are each angled with respect the vertical at an angle of about 15°.

The back walls of the coin tray 12 disposed on either side of and most proximate to the coin chute 34 and include the lower back wall portion 40 and the upper back wall portion 42. The lower and upper walls portions 40, 42 form a funnel-like passage for smoothly transferring the coins to the sorting mechanism as the coin tray 12 is upwardly pivoted. The lower portions 40 are angled with respect to the vertical at an angle of about 30°. The upper portions 42 are almost vertical being angled with respect to the vertical at an angle of about 2° according to one embodiment. The lower back wall portions 40 form an angle of about 120° with the bottom plate 35, which is substantially parallel with the horizontal when the coin tray 12 is in the first position for receiving coins. The upper back wall portions 42 form an angle of about 152° with the lower back wall portions 40. If the back wall portions 40, 42 were not angled but were substantially vertical, coins may bounce off of the vertical wall and out of the coin tray 12 and not flow into the coin chute 34. Further, coins may become "trapped" at the right angle formed by a vertical wall and the bottom plate 35. As can be seen in FIGS. 2*a* and 2*b*, the coin tray 12 fits around and pivots about the coin chute 34.

According to alternative embodiments of the coin tray 12, the slide walls 36, 38, 40, 42 of the coin tray 12 can be disposed at angles other than those described. For example, the two side walls 36 and the front wall 38 can be disposed with respect to the vertical at an angle ranging from about 0° to about 45° and each need not be disposed at the same angle as each other, the bottom portion 40 of the back wall can be disposed with respect to the vertical at an angle ranging from about 15° to about 45° and the upper potions 42 of the back wall can be disposed with respect to the vertical at an angle ranging between about 0° and about 20°. In other embodiments of the coin tray 12, the slide walls 36, 38, 40, 42 are not angled as described but are curved so that, for example, the back wall upwardly curves with an increasing slope to from a funnel-like passage to the coin chute 34. In another embodiment, the slide walls of the coin tray 12 are concave when viewing the tray from above to provide a smooth transition between the interface between the bottom 35 and the slide walls.

To prevent coins from entering the coin chute 34 prior to the operator lifting the coin tray 12, a rim 39 of the coin chute 34 is disposed above the bottom plate 35. While the coin tray is in the first coin receiving position, coins deposited in the tray 12 are preventing from entering the coin chute 34 because the coin chute 34 acts as a barrier prohibiting coins deposited in the coin tray 12 (when in the first receiving positions) from entering the opening 32 of the coin chute 34. The coins deposited in the coin tray 12 begin to flow over the rim 13 and into the coin chute 34 as the coin tray is lifted.

Figure 5:
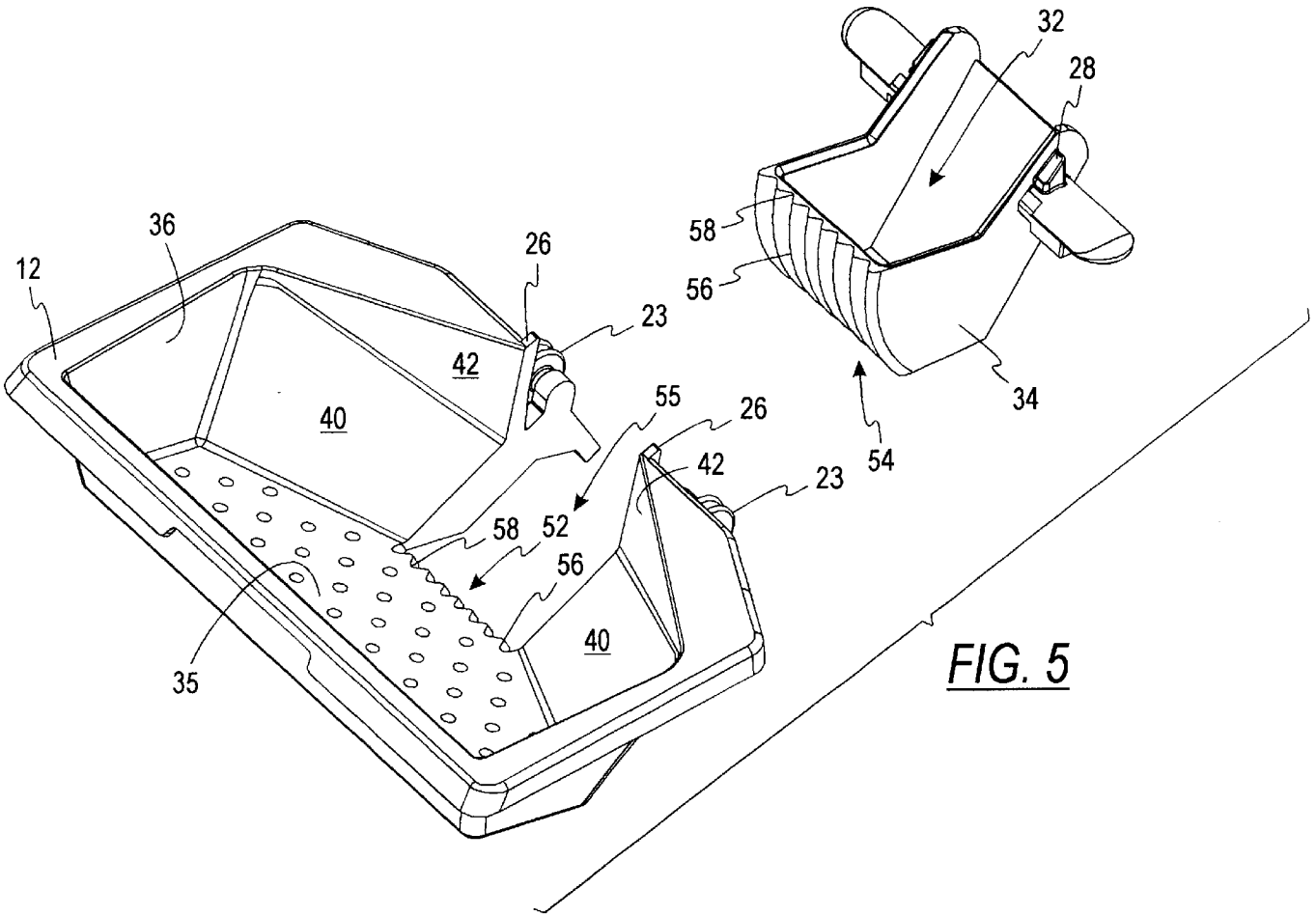
FIG. 5 is a perspective view of the coin tray and funnel of the coin processing system shown in FIG. 1.

Referring also to FIG. 5, it can be seen that the interface between the pivoting coin tray 12 and the coin chute 34 is corrugated, wherein the coin tray 12 includes a plurality of corrugations 52 and the coin chute 34 includes a plurality of corresponding corrugations 54, which receive the corrugations 52 of the coin tray 12. The coin tray 12 includes a cutout 55 that receives the coin chute 34. The corrugations 52, 54 of coin tray 12 and coin chute 34 comprise a plurality of"peaks" 56 and "valleys" 58 that mate together. The valleys 58 of the corrugations 52 of the tray 12 receive the peaks 56 of the corrugations 54 of the coin chute 34. Likewise, the valleys 58 of the corrugations 54 of the coin chute 34 receive the peaks 56 of the corrugations 52 of the coin tray 12. According to alternative embodiments of the present invention, the corrugations 52 of the coin tray 12 and the corrugations 54 of the coin chute 34 are mated (i.e., peaks extending into valleys) to varying extents when the coin tray 12 is in the first position, the second position or is pivoting between the two positions. In other alternative embodiments, the corrugations 52, 54 are slightly withdrawn from one another when the coin tray 12 is in the first position, the second position or when pivoting between the two positions. For example, the peaks 56 of the corrugations 52, 54 may extend well inside of the valleys 58 while the coin tray 12 in the first position, but may move slightly away from one another as the coin tray is pivoted toward the second position.

The corrugations 52, 54 of the coin tray 12 and the coin chute 34 reduce, or practically eliminate, any gap between the coin tray 12 and the coin chute 34 though which a coin may pass. According to one embodiment of the present invention, the peaks 56 of the corrugations 54 of the coin chute 34 never completely pull out of the valleys 58 of the corrugations 52 of the coin tray 12. Likewise, the peaks 56 of the corrugations 52 of the coin tray 12 do not completely withdraw from the valleys 58 of the corrugations 54 of the coin chute 34 as the coin tray is moved from the first coin receiving position to a second coin transferring position. In another embodiment, the peaks 56 only slightly withdraw from the valleys as distance less than the thickness of the thinnest coin the coin processing device 10 is designed to process.

Figure 6:
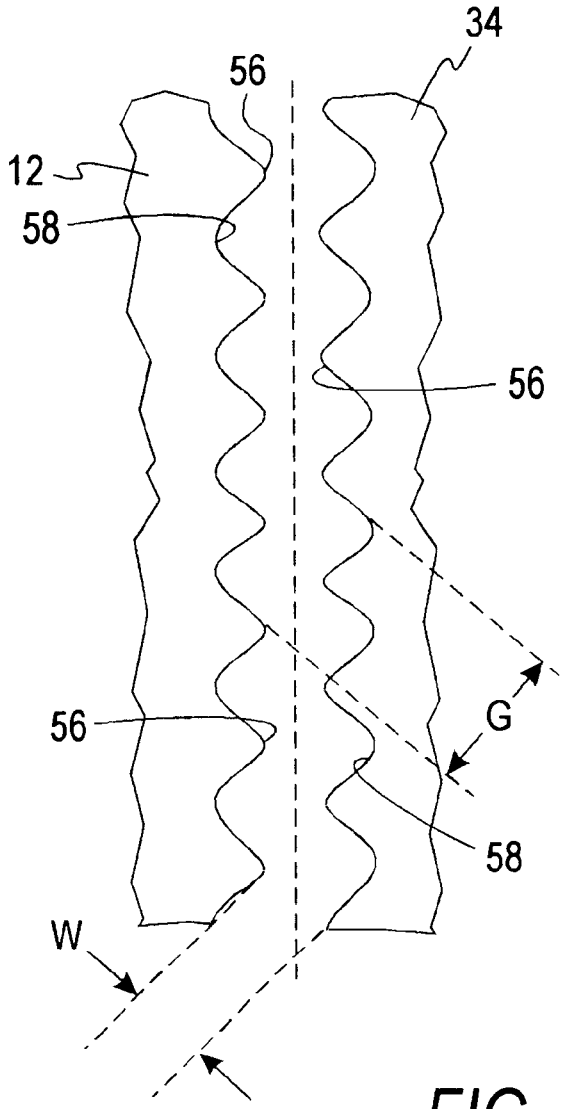
FIG. 6 is a top view of a corrugated interface between the coin tray and funnel of the coin processing system shown in FIG. 1.

Turning now to FIG. 6, the peaks 56 are shown slightly withdrawn from the valleys 58. The corrugated interface between the coin tray 12 and the coin chute 34 prohibits coins from passing through any gap forming between the coin tray 12 and the coin chute 34 because the peaks 56 and valleys 58 are sized and arranged so that the largest gap(s) G between the coin tray 12 and the coin chute 34 is smaller than the diameter of the smallest coin that the corresponding device is designed to processes. In another embodiment of the coin tray 12, the peaks and valleys 58 are sized and arranged so that width W of any gap G longer than the diameter of the smallest coin to be processed is less than the thickness of the thinnest coin that the coin sorter 10 is designed to accommodate. Therefore, coins are unable to pass between the coin tray 12 and the coin chute 34.

While the corrugations 52, 54 have been shown as rounded peaks and valleys, the corrugations can include sharp peaks and valleys. According to other alternative embodiments, the interface between the pivoting coin tray 12 and the coin chute 34 is not corrugated, but is comprised of discrete members (e.g. fingers, protrusions, rods, etc.) that are interleaved together in order to minimize the gap between. For example, the coin tray 12 can includes a plurality of rectangular-shaped, spaced-apart members extending therefrom that extend into the spaces between a plurality of rectangular shaped, spaced-apart members extending from the coin chute 34.

If the operator wishes to discontinue coin feeding coins into the coin sorter 10, the operator pivots the coin tray 12 towards the first position until the level of the coins in the coin tray 12 is no longer above the rim 38 of the coin chute 32. Because the coin chute 34 is relatively small compared to the size of the coin tray 12, few coins fall into the sorting mechanism of the coin sorter 10 after the coin tray 12 is lowered.

Figure 7:
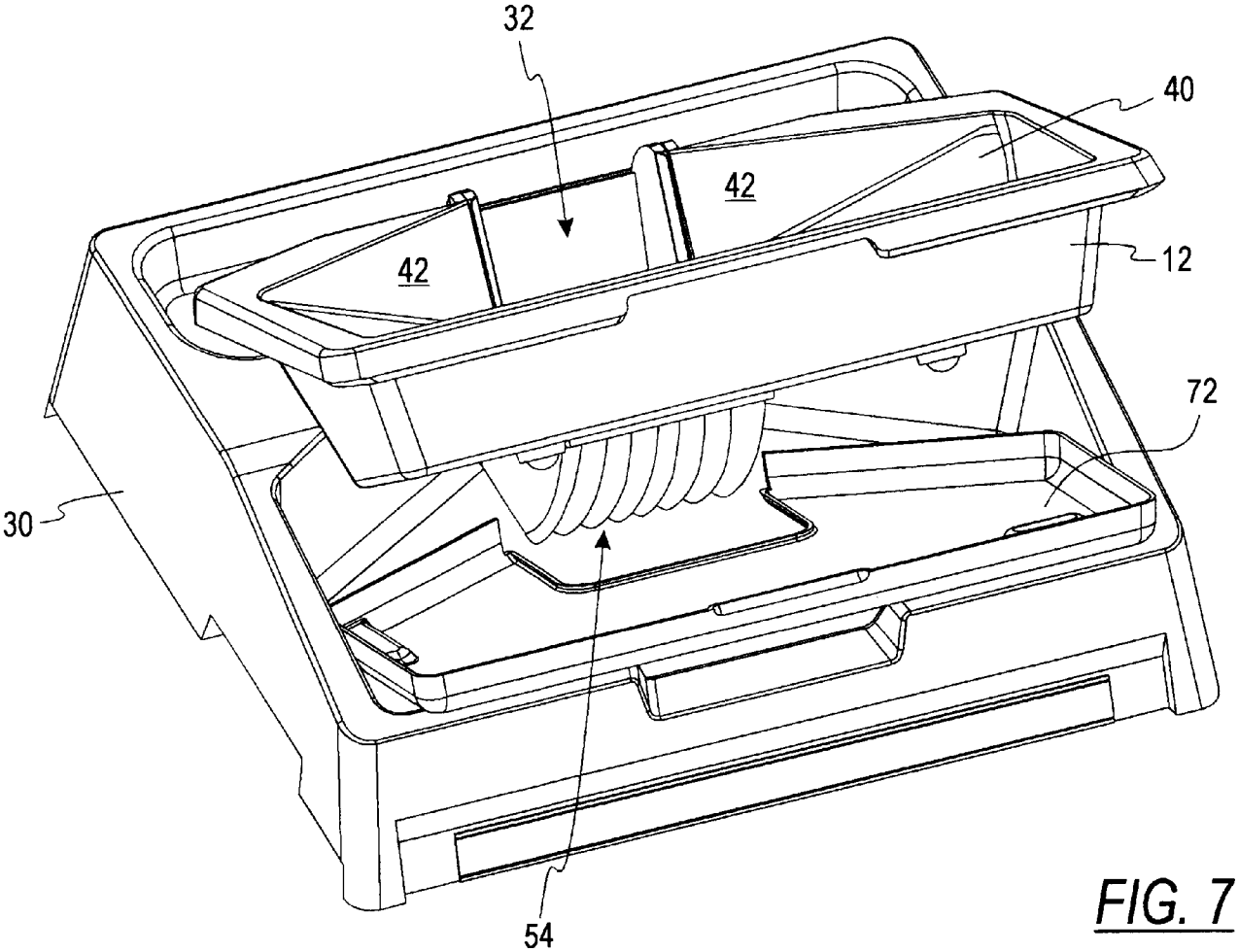
FIG. 7 is a perspective view of the coin tray of the coin processing system of FIG. 1 showing a debris pan partially removed from a base of the coin tray.

The bottom plate 35 of the coin tray is perforated according to one embodiment of the present invention. The perforations 70 are sized to have a diameter smaller than the smallest diameter of coins to be processed so that debris (having a diameters smaller than the diameter of the perforations) including dust, dirt, metal shavings, paper balls, etc. pass through the perforations, but coins do not. Debris passing through the perforations 70 is collected on in the base 30. Referring to FIG. 7, alternatively, a removable debris pan 72 (FIGS. 2*b* and 7) is disposed in the base 30, under the coin tray 12, for collecting debris passing through the perforations 70. In such an embodiment, an operator can remove the debris pan and empty it into a refuse container, rather than pick out the debris from the base 30.

To protect the sorting mechanism of the coin sorter 12 from damage caused by ferromagnetic objects, one or more magnets (not shown) are attached to an inner wall of the coin chute 34. Objects such as steel screws and washers, which are too large to filter through the perforations 70, are attracted to the magnet(s). The magnet(s) holds the objects until the operator removes them. Alternatively, forming the entire coin chute from a magnetic material also effectively prevents ferromagnetic objects from entering the sorting mechanism of the coin sorting device 10. Alternatively still, the interior of the coin chute 34 is lined with a magnetic material for collecting ferromagnetic objects.

The coin tray 12, base 30 and funnel are made of any rigid material, such as plastic or other polymeric material or metal, that is durable and can withstand coins being deposited (i.e., dumped thereon). For example, injection molded plastic forms a lightweight, rigid and structurally sound coin tray 12, base 30 and coin chute 34 which is easy to use and is inexpensive to manufacture according to one embodiment of the present invention.

The corrugated interface between the pivoting coin tray 12 and the coin chute 34 allows for greater manufacturing tolerances in the manufacture of the coin tray 12 and coin chute 34. As discussed above in the Background Section, the prior art devices are manufactured with very tight tolerances for reducing the size of the gap between the coin tray and coin chute. Turing back to the present invention, the corrugations 52, 54 of the coin tray 12 and coin chute 34 mesh together in a manner to lessen the impact any variations in the coin tray and coin chute occurring during the manufacturing of these parts.

While the invention is susceptible to various modifications and alternative forms, specific embodiments have been shown by way of example in the drawings and described in detail herein. It should be understood, however, that the invention is not intended to be limited to the particular forms disclosed. Rather, the invention is to cover all modifications, equivalents and alternatives falling within the spirit and scope of the invention as defined by the appended claims.

What is claimed is:

1. A coin input apparatus for a coin processing device, the apparatus comprising:

a coin tray pivotally coupled to the coin processing device, the coin tray adapted to pivot between a first position for receiving coins to be processed and a second position for feeding coins into the coin processing device, the coin tray having a first corrugated surface; and a coin chute having a first opening for receiving coins from the coin tray and a second opening for directing coins into the coin processing device, the coin chute having a second corrugated surface for mating with the coin tray.

2. The apparatus of claim 1 wherein the corrugated surface of the coin chute is mated with the corrugated edge of the bottom of the coin tray when the coin tray is in the first position.

3. The apparatus of claim 1 wherein the corrugated surface of the coin chute is mated with the corrugated surface of the coin tray when the coin tray is in the second position.

4. The apparatus of claim 1 wherein the corrugated surface of the coin chute is mated with the corrugated surface of the coin tray while the coin tray pivots between the first position and the second position.

5. The apparatus of claim 1 wherein the coin tray includes a bottom having a plurality of perforations.

6. The apparatus of claim 5 wherein the diameter of each of the perforations is smaller than the diameter of the smallest coin that the coin processing device is adapted to process.

7. The apparatus of claim 5 further comprising a removable debris pan disposed below the coin tray for collecting an item that passes through the perforations.

8. The apparatus of claim 1 further comprising a magnet disposed along an interior surface of the coin chute.

9. The apparatus of claim 1 wherein the first opening of the coin chute is disposed above the bottom of the coin tray when the coin tray is in the first position.

10. The apparatus of claim 1 further comprising at least one stop disposed on the coin tray for prohibiting pivoting of the coin tray beyond a predetermined point.

11. The apparatus of claim 1 wherein the corrugations of the bottom of the coin tray withdraw from the corrugations of the coin chute when the coin tray is moving from the first position to the second position.

12. The apparatus of claim 11 wherein a gap is formed between the corrugations of the coin tray and the corrugations of the coin chute, the gap having a largest dimension that is less than the diameter of the smallest coin that the coin processing device is adapted to accommodate.

13. The apparatus of claim 11 wherein a gap is formed between the corrugations of the coin tray and the corrugations of the coin chute, the gap having a width that is less than the thickness of the thinnest coin that the coin processing device is adapted to accommodate.

14. The apparatus of claim 1 wherein the corrugations of the surface of the coin tray withdraw from the corrugations of the coin chute when the coin tray is in the second position.

15. The apparatus of claim 14 wherein a gap is formed between the corrugations of the coin tray and the corrugations of the coin chute, the gap having a largest dimension that is less than the diameter of the smallest coin that the coin processing device is adapted to accommodate.

16. The apparatus of claim 14 wherein a gap is formed between the corrugations of the coin tray and the corrugations of the coin chute, the gap having a width that is less than the thickness of the thinnest coin that the coin processing device is adapted to accommodate.

17. The apparatus of claim 1 wherein the corrugations of the bottom of the coin tray withdraw from the corrugations of the coin chute when the coin tray is in the first position.

18. The apparatus of claim 17 wherein a gap is formed between the corrugations of the coin tray and the corrugations of the coin chute, the gap having a largest dimension that is less than the diameter of the smallest coin that the coin processing device is adapted to accommodate.

19. The apparatus of claim 17 wherein a gap is formed between the corrugations of the coin tray and the corrugations of the coin chute, the gap having a width that is less than the thickness of the thinnest coin that the coin processing device is adapted to accommodate.

20. A coin input apparatus for a coin processing device, the apparatus comprising:

a coin tray pivotally coupled to the coin processing device, the coin tray adapted to pivot between a first position for receiving coins to be processed and a second position for feeding coins into the coin processing device, the coin tray having a bottom and a plurality of side walls upwardly extending therefrom, the bottom having an edge having a plurality of peaks and valleys, and a coin chute for guiding coins from the coin tray into the coin processing device, the coin chute having a surface having a plurality of peaks and valleys, the valleys of the surface of the coin chute being adapted to receive the peaks of the edge of the coin tray, the valleys of the edge of the coin tray being adapted to receive the peaks of the surface of the coin chute.

21. The apparatus of claim 20 wherein the peaks of the edge of the coin tray are at least partially received in the valleys of the surface of the coin chute and the peaks of the surface of the coin chute are at least partially received in the valleys of the edge of the coin tray when the coin tray is in the first position.

22. The apparatus of claim 20 wherein the peaks of the edge of the coin tray are at least partially received in the valleys of the surface of the coin chute and the peaks of the surface of the coin chute are at least partially received in the valleys of the edge of the coin tray when the coin tray is in the first position.

23. The apparatus of claim 20 wherein the peaks of the edge of the coin tray are at least partially received in the valleys of the surface of the coin chute and the peaks of the surface of the coin chute are at least partially received in the valleys of the edge of the coin tray while the coin tray pivots between the first position and the second position.

24. The apparatus of claim 20 wherein the plurality of side walls of the coin tray include a first side wall disposed on one side of the coin chute and a second side wall disposed on another side of the coin chute, the first and second side walls forming a funnel-like passage for guiding coins into the coin chute.

25. The apparatus of claim 24 wherein the first and second side walls slope upwardly from the bottom of the coin tray toward the coin chute.

26. The apparatus of claim 25 wherein each of the first and second side walls comprise a first portion and a second portion, the first portion being disposed at a first angle with respect to the bottom of the coin tray, the second portion being sloped at a second angle with respect to the bottom of the coin tray, the second angle being greater than the first angle.

27. The apparatus of claim 26 wherein the first portion is substantially planar and the second portion is substantially planar.

28. The apparatus of claim 20 further comprising at least one stop disposed on the coin tray for prohibiting pivoting of the coin tray beyond a predetermined point.

29. The apparatus of claim 20 wherein the peaks of the edge of the coin tray are withdrawn from valleys of the surface of the coin chute and the peaks of the surface of the coin chute are withdrawn from the valleys of the edge of the coin tray when the coin tray is in the second position.

30. The apparatus of claim 29 wherein a gap is formed between the peaks and valleys of the coin tray and the peaks and valleys of the coin chute, the gap being sized to prevent coins from passing through the gap.

31. The apparatus of claim 20 wherein the peaks of the edge of the coin tray are withdrawn from the valleys of the surface of the coin chute and the peaks of the surface of the coin chute are withdrawn from the valleys of the edge of the coin tray when the coin tray is in the second position.

32. The apparatus of claim 31 wherein a gap is formed between the peaks and valleys of the coin tray and the of the coin chute, the gap being sized to prevent coins from passing through the gap.

33. The apparatus of claim 20 wherein the peaks of the edge of the coin tray are withdrawn from valleys of the surface of the coin chute and the peaks of the surface of the coin chute are withdrawn from the valleys of the edge of the coin tray while the coin tray pivots from the first position the second position.

34. The apparatus of claim 33 wherein a gap is formed between the peaks and valleys of the coin tray and the peaks and valleys of the coin chute, the gap being sized to prevent coins from passing through the gap.

35. The apparatus of claim 20 wherein the coin tray has a cutout disposed in one side of the coin tray for receiving the coin chute, a portion of the bottom of the coin tray including the edge having a plurality of peaks and valleys.

36. A coin processing machine comprising:

a device for processing coins inputted into the machine;

a coin tray pivotally coupled to the machine for feeding coins into the device, the coin tray having a corrugated surface; and a coin chute for guiding coins from the coin tray into the device, the coin chute having a corrugated surface for mating with the corrugated surface of the coin tray for minimizing a gap between the coin tray and the coin chute.

37. The apparatus of claim 36 wherein the gap has a largest dimension that is less than the diameter of the smallest coin that the coin processing machine is adapted to accommodate.

38. A coin processing machine, comprising:

a device for processing coins inputted into the machine; coin chute for guiding coins into the device, the coin chute having a surface with a first series of discrete members; and a coin tray for receiving coins in a first position and pivoting upwardly to a second position for feeding coins into the coin chute, the coin tray having a surface adjacent to said chute with a second series of discrete members that are interleaved with the first series of discrete members of said coin chute for minimizing a gap between the coin tray and the coin chute.

39. The machine of claim 38 wherein the first and second series of interleaved members and corrugated members.

40. A method of inputting coins to a coin processing device, the method comprising:

receiving a plurality of coins to be processed with a coin tray disposed in a first position, the coin tray having a surface with a first series of discrete members; and pivoting the coin tray to a second position for moving received coins, under the force of gravity, into a coin chute, the coin chute including a second series of discrete members that interleave with the first series of discrete members of the coin tray.

41. A coin processing machine, comprising:

a device for processing coins inputted into the machine;

a coin tray for receiving coins in a first position and pivoting upwardly to a second position for feeding coins into the a device for processing coins, the coin tray having at least one surface having a plurality of perforations for permitting debris having a dimension less than a diameter of the perforations to pass through; and a removable debris pan disposed below the surface of the coin tray having the plurality of perforations for collecting debris passing through the perforations.

42. The coin processing machine of claim 41 further comprising a coin chute for guiding coins from the coin tray, when in the second position, into the device for processing coins, wherein the coin chute has a first corrugated surface for mating with a second corrugated surface of the coin tray.

* * * * *